US009259605B1

(12) United States Patent
Puig et al.

(10) Patent No.: US 9,259,605 B1
(45) Date of Patent: Feb. 16, 2016

(54) EXERCISE DEVICE AND METHOD

(76) Inventors: Peter A. Puig, Davie, FL (US); Felix A. Doval, Davie, FL (US); Paul Solis, Davie, FL (US)

( * ) Notice: Subject to any disclaimer, the term of this patent is extended or adjusted under 35 U.S.C. 154(b) by 831 days.

(21) Appl. No.: 13/162,398

(22) Filed: Jun. 16, 2011

Related U.S. Application Data

(63) Continuation-in-part of application No. 13/083,079, filed on Apr. 8, 2011.

(60) Provisional application No. 61/321,935, filed on Apr. 8, 2010.

(51) Int. Cl.

| | |
|---|---|
| ***A63B 21/068*** | (2006.01) |
| ***A63B 71/00*** | (2006.01) |
| ***A63B 21/00*** | (2006.01) |
| ***A63B 7/00*** | (2006.01) |

(52) U.S. Cl.
CPC ..... *A63B 21/00185* (2013.01); *A63B 7/00* (2013.01); *A63B 21/068* (2013.01); *A63B 21/4013* (2015.10); *A63B 21/4015* (2015.10); *A63B 21/4019* (2015.10); *A63B 21/4034* (2015.10); *A63B 21/4035* (2015.10)

(58) Field of Classification Search
CPC ..... A63B 7/00; A63B 7/02; A63B 7/04; A63B 21/00185; A63B 21/068; A63B 21/1423; A63B 21/1426; A63B 21/143; A63B 21/1434; A63B 21/1438; A63B 21/1442; A63B 21/1476
USPC ..... 482/23–24, 44, 49, 91–96, 131
See application file for complete search history.

(56) References Cited

U.S. PATENT DOCUMENTS

| | | | | |
|---|---|---|---|---|
| 735,065 | A * | 8/1903 | Chellis | 482/129 |
| D373,803 | S * | 9/1996 | Winans | D21/684 |
| 6,039,677 | A * | 3/2000 | Spletzer | 482/105 |
| 7,785,244 | B2 * | 8/2010 | Hetrick | 482/139 |
| 8,007,413 | B1 * | 8/2011 | Wu | 482/91 |
| 8,152,704 | B2 * | 4/2012 | Brice et al. | 482/129 |
| D674,448 | S * | 1/2013 | Puig et al. | D21/662 |
| D694,414 | S * | 11/2013 | Sparkes | D24/190 |
| 2007/0173383 | A1 * | 7/2007 | Feigenbaum et al. | 482/91 |
| 2013/0217547 | A1 * | 8/2013 | Hinds et al. | 482/96 |

* cited by examiner

*Primary Examiner* — Oren Ginsberg
(74) *Attorney, Agent, or Firm* — H. John Rizvi; Gold & Rizvi, P.A.

(57) ABSTRACT

An exercise device includes at east one inelastic strap assembly including an inelastic strap having a first end and a second end, a hand grip located at the first end of the inelastic strap, a grip handle carried by the hand grip, a foot grip carried by either the hand grip or the grip handle, and a heel strap carried by the foot grip. The heel strap defines a first plane. The foot grip defines a second plane, wherein the first plane is preferably generally perpendicular to the second plane. In use, the exercise device can be gripped in a variety of manners. The user can hold the grip handle with their hand. The user can secure their foot to the dived by positioning the foot grip behind a user's ankle and the ankle grip against an individual's foot arch.

18 Claims, 12 Drawing Sheets

EXERCISE DEVICE AND METHOD

CROSS-REFERENCE TO RELATED APPLICATIONS 10001.1 This Continuation-in-Part Patent Application claims the benefit of co-pending Non-Provisional Utility patent application Ser. No. 13/083,079, filed on Apr. 8, 2011, which claims benefit of U.S. Provisional Patent Application Ser. No. 61/321,935, filed on Apr. 8, 2010, which are incorporated herein in their entireties.

FIELD OF THE INVENTION

The present disclosure generally relates to exercise devices. More particularly, the disclosure is directed to an exercise device and method in which the exercise device is easily attached to a door, cross beam, pole, tree or other support to facilitate a wide variety of exercises.

BACKGROUND OF THE INVENTION

Exercise is physical activity that is planned, structured, and repetitive for the purpose of conditioning any part of the body. Exercise is utilized to improve health and maintain fitness and is also important as a means of physical rehabilitation.

Exercise is useful in preventing or treating coronary heart disease, osteoporosis, weakness, diabetes, obesity and depression. Range of motion is one aspect of exercise, which is important for increasing or maintaining joint function. Strengthening exercises impart resistance to the muscles, increasing endurance and strength. Cardiac rehabilitation exercises may be developed and individualized for rehabilitation purposes or to prevent cardiac disorders and diseases. A well-balanced exercise program can improve general health, build endurance and delay many of the effects of aging. The benefits of exercise include not only improvement in physical health but also enhancement of an exerciser's emotional well being.

Exercise further helps improve symptoms related to fatigue, distress, cognitive problems and mental health functioning. The American Heart Association has released a statement, which indicates that exercise is beneficial even for patients awaiting heart transplants. A recent study has shown that women who participate in strenuous physical activity over a number of years may reduce their risk of breast cancer. Additionally, research has shown that men and women aged 40 to 50 who exercise moderately for 60 to 90 minutes a day are less likely to catch a cold than their more sedentary counterparts.

Resistance training is a form of strength training exercise in which effort is exerted against resistance (i.e. resistance to being pushed, squeezed, stretched or bent). Resistance to movement may be exerted against a muscle or a muscle group by an opposing muscle or muscle group, by gravity or by an elastic band or bands. There are two basic types of resistance exercises: isotonic resistance exercises and isometric resistance exercises. Isotonic resistance exercises are those in which a body part moves against resistance, whereas isometric resistance exercises are those in which a body part remains still as it maintains static force against resistance. Both isotonic and isometric resistance exercises may be used to develop the strength and size of skeletal muscles. Properly performed, resistance training can provide significant functional benefits and improvement in overall health and well being.

A variety of exercise devices, which include straps and hand grips and can be secured to a structure such as a door or pole for use are known in the art. One conventional exercise device of this type includes an inelastic adjustable length member with two arms and a grip at both ends. A centrally located anchor facilitates distribution of the length between the arms. In one embodiment, the exercise device is compact and can be removably attached to a doorframe. When user grabs the grips and uniformly pulls away from the anchor, the arms of the device center on the anchor. However, since the device includes a single, elongated strap that extends through the anchor, unexpected movements of the strap may occur while the user is holding his or her body weight with the straps during an exercise. These unexpected movements of the strap may potentially result in muscle tear.

Also known is an exercise device for use with a door, comprising a flat, flexible strap, a pair of hand grips attached to opposite ends of the flat, flexible strap, and an anchor attached to the flat, flexible strap midway between the hand grips and extending laterally from opposite sides of the strap for engagement with the door with the flat, flexible strap passing between an edge of the door and the adjacent jamb, and the anchor and the hand grips being positioned on opposite sides of the door.

Another conventional exercise device includes a pair of handles that are connected to an elastic cord. A loop strap is provided at the approximate midpoint of the length of the elastic cord. The loop strap is interposed between a door and a doorjamb with the loop strap being mounted on the doorknob of the door. A user grips the handles and applies resistance against the elastic cord to strengthen the muscles in the user's arms.

Another conventional exercise device is adapted for connection to at least one structural component of a building to provide a framework for kinesthetic exercises. The structural component defines multiple fixable locations for connection of various kinesthetic exercising apparatuses in arrangements, which are suitable for a variety of kinesthetic exercises. The device further includes mechanisms for quick releasable and replaceable coupling of an exercise apparatus in a freely rotatable manner to accommodate a wide range of body motions.

Another conventional exercise device is portable and includes hand grips attached to opposite ends of a cable, which is trained over a pulley for reciprocation during an exercise. Straps are attached to opposite ends of a second cable trained over a pulley and are adapted to receive the feet of a user for reciprocation during exercise.

Another conventional exercise device includes several interchangeable parts and facilitates stretching and strengthening of the upper and lower torso. The exercise device also utilizes a common door and doorframe, allowing for simplicity and generality of use. The device includes an adjustable hook and loop strap for ease of attachment to the ankle, wrist, or foot of the user as well as configurable handles to accommodate double or single-handed use. In use, the device is anchored to a common door and doorframe using a rod and cloth strap. The rod is fixedly and removably placed behind the closed door. A variety of upper and lower torso stretching exercises can be carried out by wrapping the strap around the user's ankle, wrist or foot and guiding or stretching the body portion with a free hand or hands which is/are attached to the strap via a rope. Similarly, strengthening exercises can be carried out by using elastic tubing to provide resistance for the appropriate body portion.

Another conventional exercise device includes a chest expander having a first handle at one end, second and third handles at an opposite end and multiple elastic cord members detachably connected between the first handle and the second and third handles. A coupling belt is secured to the first handle using hook and loop fasteners. A transverse bar is inserted through respective loops at the two distal ends of the coupling belt. The transverse bar is adapted to secure the exercise device to a top or bottom door gap and enables the user to pull the second and third handles to exercise the muscles of the arms.

Although the above-described exercise devices and methods address some of the needs of the exercise device market, an exercise device including inextensible straps attached through rings to a single holder is still desired.

SUMMARY OF THE INVENTION

This disclosure is generally directed to an exercise device including inelastic strap members with which a user may perform several different types of exercises in a portable and safe manner.

In one aspect, an exercise device has at least one inelastic strap assembly that includes an inelastic portion with a first end and a second end. The first end includes a first loop, a foot strap, and a hand grip attached to the first loop. An attachment mechanism interfaces the first loop and foot strap to permit selectively attaching and removing the foot strap from the first loop.

In another aspect, an exercise device has at least one inelastic strap assembly that includes an inelastic portion with a first end and a second end. The first end includes a first loop, a foot strap, and a hand grip attached to the first loop. The foot strap is discontinuous has two ends and an attachment mechanism at each end for selectively attaching and removing the foot strap from said first loop. An anchor is affixed to the second end of the inelastic portion of the inelastic strap assembly.

According to a further aspect, an exercise device has two inelastic strap assemblies wherein each strap assembly includes an inelastic portion with a first end and a second end. The first end includes a first loop, a foot strap, and a hand grip attached to the first loop. The foot strap at the end of each inelastic strap assembly is discontinuous having two ends and an attachment mechanism at each end for selectively attaching and removing the foot strap from the first loop. The second end of each inelastic strap assembly includes a rigid ring defining a central aperture. An anchor comprises an inelastic anchor strap having a buckle at a first end thereof for securely receiving a second end of the anchor strap to form an anchoring loop wherein the anchor strap extends through the aperture of each rigid ring.

These and other features, aspects, and advantages of the invention will be further understood and appreciated by those skilled in the art by reference to the following written specification, claims and appended drawings.

BRIEF DESCRIPTION OF THE DRAWINGS

The invention will now be described, by way of example, with reference to the accompanying drawings, where like numerals denote like elements and in which.

Like reference numerals refer to like parts throughout the various views of the drawings.

DETAILED DESCRIPTION OF THE EMBODIMENTS

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
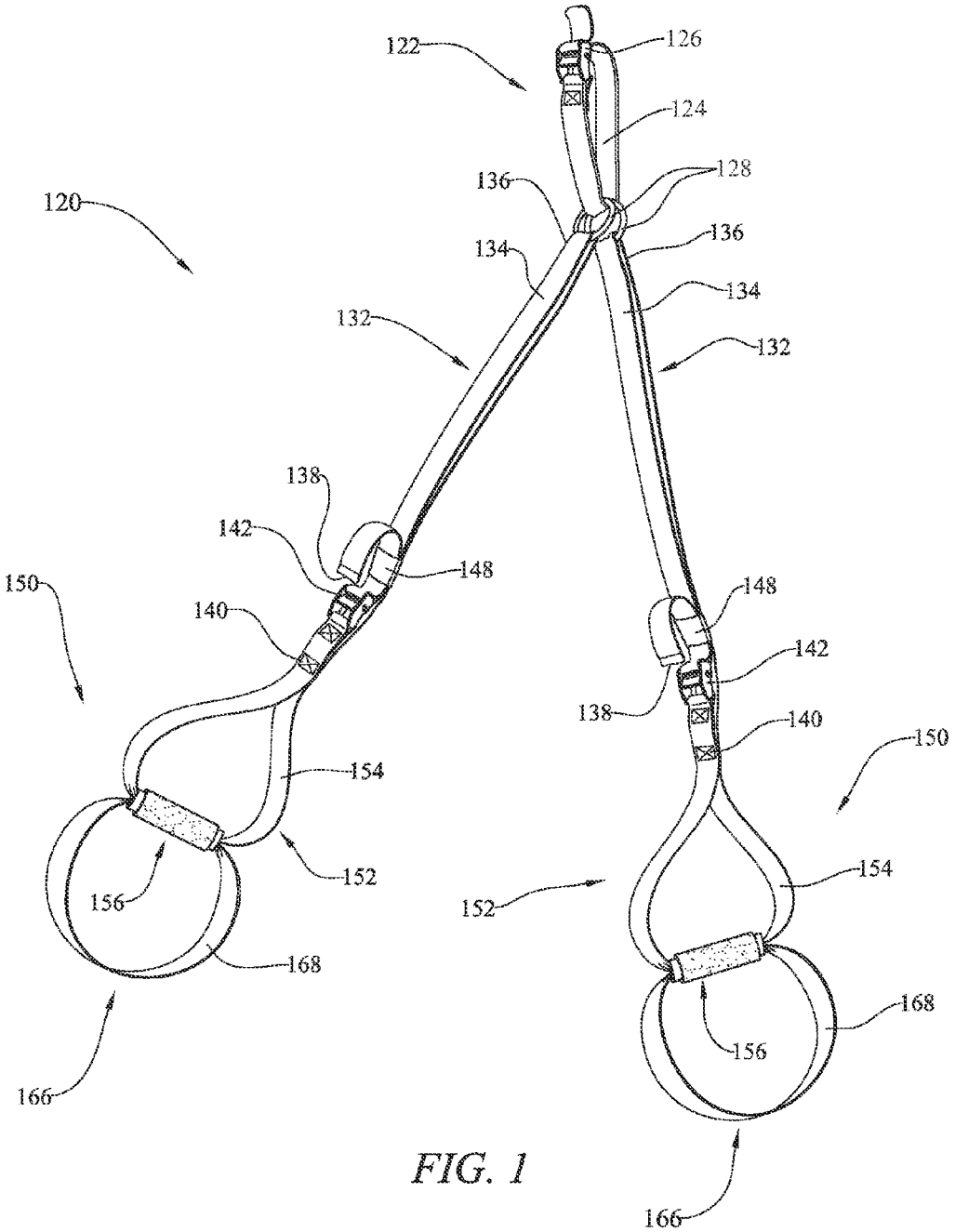
FIG. 1 presents a general perspective view of an illustrative embodiment of the exercise device.

Turning to the drawings, FIG. 1 shows an exercise device that is one of the preferred embodiments of the present invention and illustrates its various components. As shown in the various figures, the exercise device is easily attached to a door, cross beam, pole, tree or other support to facilitate a wide variety of exercises. Exercise device 120 may include a generally elongated inelastic strap assembly 132 and in a preferable embodiment, includes two generally elongated inelastic strap assemblies 132. An anchor end 136 of each of the inelastic strap assemblies 132 is attached to an anchor 122, A grip end 150 is at an opposite end of inelastic strap assembly 132.

The grip end 150 of each inelastic strap assembly 132 includes a hand grip 152 and a foot grip 166. Hand grip 152 includes a hand strap 154 that extends from the corresponding inelastic strap assembly 132. Hand grip 152 further includes a grip handle 156 formed of a grip cylinder 158 (FIG. 4) that may be externally covered with a cushioned layer 160. Grip cylinder 158 has a generally elongated, cylindrical shape wherein hand strap 154 extends through the interior of grip cylinder 158.

Foot grip 166 is provided on the end of hand grip 152. In some embodiments, foot grip 166 comprises a foot strap 168 formed as a loop, which extends through the interior of grip cylinder 158. Foot grip 166 generally defines a flexible stirrup-like structure through which a user 102 (FIG. 8) may insert his/her foot to perform various exercises in use of the exercise device 120, as described in further detail below.

Figure 4:
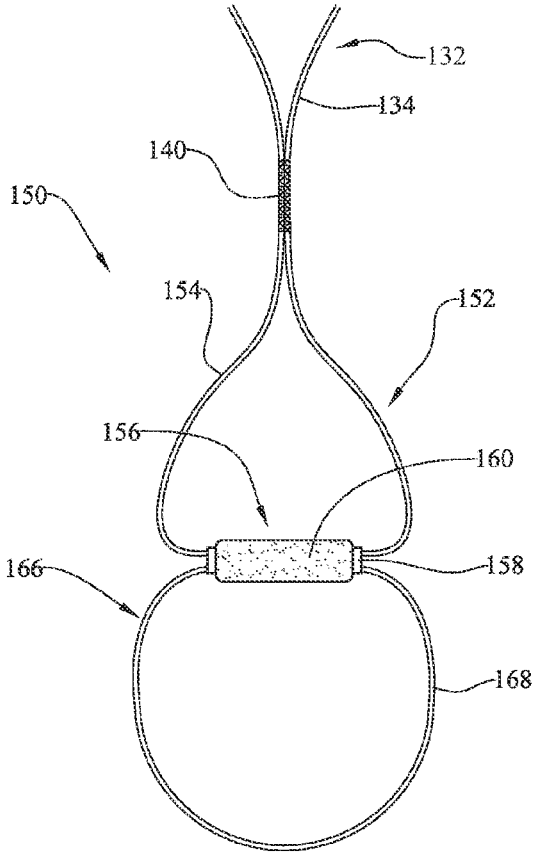
FIG. 4 presents a front elevation view of the handle grip and the foot grip portion of the inelastic strap assembly.

As illustrated in FIG. 4, each inelastic strap assembly 132 is constructed of an inelastic strap 134 which, at grip end 150 is doubted back upon itself to form first loop 154 of hand grip 152 and has stitching portion 140 to permanently affix portions of strap 134 one to the other and define hand strap 154. Adjacent portions of inelastic strap 134 extend from stitching portion 140 to an anchor end 136 of the inelastic strap 134 and form a loop at the anchor end 136. Hand strap 154 can also include a grip handle 156 comprising a grip cylinder 158 having an outer cushioned layer 160 to provide comfortable gripping for a user's hands. Grip handle 156 is retained on hand strap 154 by passing hand strap 154 through an interior of grip cylinder 158. As further illustrated in FIG. 4, foot strap 168 can also be formed in a loop and be retained on inelastic strap assembly 132 by passing through the interior of grip cylinder 158.

Figure 5:
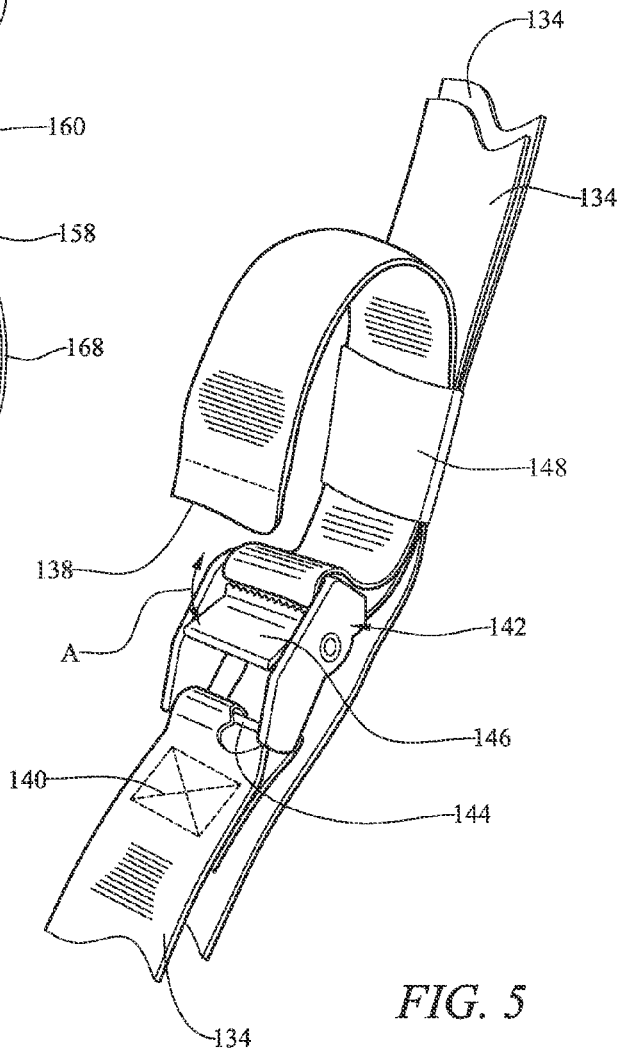
FIG. 5 presents a perspective view of a buckle for use in regulating the length of each strap.

Optionally, as illustrated in FIGS. 1 and 5, continuous inelastic strap 134 can include a buckle 142 positioned along inelastic strap 134 thereby providing user 102 with the ability to adjust the length of inelastic strap assembly 132. Buckle 142 can be of any conventional buckle design that is suitable to facilitate selective adjustment of the length of inelastic strap assembly 132.

An end of inelastic strap 134 is secured around a cross pin 144 of buckle 142 such as via, the stitching portion 140. An opposite free end 138 of inelastic strap 134 can be secured around a second retaining pin (not illustrated) on buckle 142 and is engaged and retained by a tongue grip 146 which is pivotally attached to the buckle 142. Accordingly, by pivoting tongue grip 146 about arc "A" (FIG. 5) to closed/engaged position on buckle 142, the tongue grip 146 engages free end 138 of inelastic strap 134 and prevents inelastic strap assembly 132 from inadvertently shortening or lengthening. By pivoting of the tongue grip 146 to an open/disengaged position on buckle 142, tongue grip 146 disengages free end 138 of inelastic strap 134 such that a user may adjust the length of inelastic strap assembly 132 as desired by freely pulling free end 138.

Hand strap 154 of each hand grip 152 may be attached to the corresponding buckle 15 via, stitching portion 140 and/or other suitable attachment technique. Accordingly, the length of each inelastic strap assemblies 132 may be selectively adjusted through the adjusting action of one or both of buckles 142. In some embodiments, a sleeve 148 may retain the free end 138 of inelastic strap 134 in a conventional manner.

Figure 2:
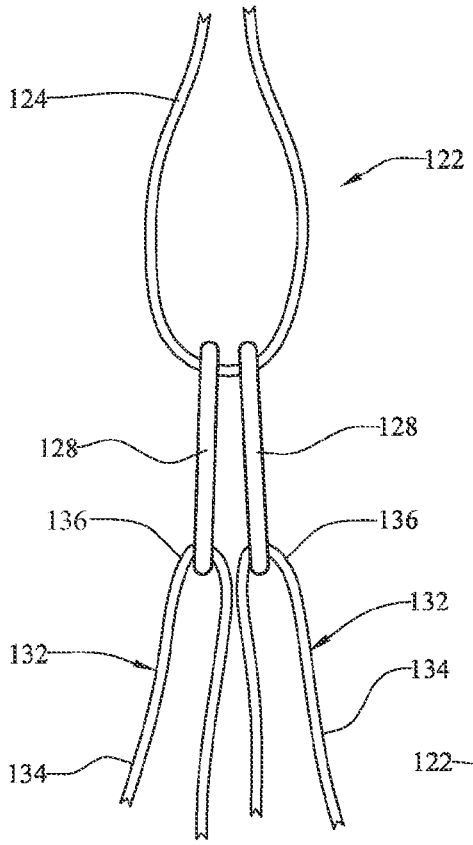
FIG. 2 presents an enlarged sectional view showing in detail the attachment of the inelastic strap assemblies to the anchor strap.
Figure 3:
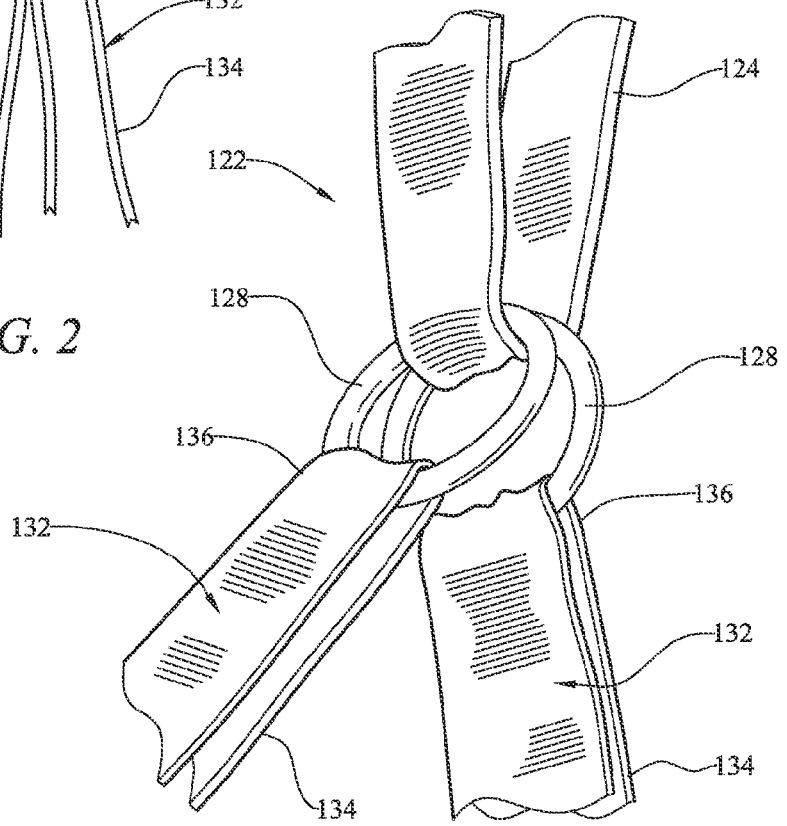
FIG. 3 presents another perspective view of the attachment of the inelastic strap assemblies to the anchor strap.

Referring now to FIGS. 1-3, anchor 122 generally comprises an anchor strap 124 having two ends with an anchor buckle 126 attached to one end and having an opposite free end for engagement in buckle 126. Anchor ends 136 of inelastic strap assemblies 132 are engaged with anchor strap 124 and are slidable along a length of anchor strap 124. Anchor strap 124 with buckle 126 can be secured in a looped configuration and with which anchor strap 124 is secured and adjusted during the attaching procedure. Optionally, inelastic strap assembly 132 can include a rigid anchor ring 128 at anchor end 136. Rigid anchor ring 128 defines a central aperture for receiving strap 134 and anchor strap 124 therethrough in a manner to permit inelastic strap assembly 132 to slide along the length of anchor strap 124. Accordingly, anchor strap 124 with buckle 126 may facilitate attachment of the exercise device 120 to any of various structures (not illustrated) such as a house door, a gym pole or a cross beam, for example and without limitation, in use of the exercise device 120 which will be hereinafter described.

Strap 134, anchor strap 124, the hand strap 154 forming hand grip 152 and foot strap 168 forming foot grip 166 are typically formed of materials that include but are not limited to straps of natural or synthetic webbing materials having a strength sufficient to support the weight of a user of the exercise device 120. Exemplary webbing materials include but are not limited to nylon, polyethylene, polypropylene and other polymeric fibers. Moreover, in some embodiments, stitching portions 140 may attach the looped portions of hand strap 154 of hand grip 152 to one another. Those practiced in the art will understand that the length of each inelastic strap assemblies 132 may vary depending on the height of user 102 to facilitate the effective use of exercise device 120.

Figure 6:
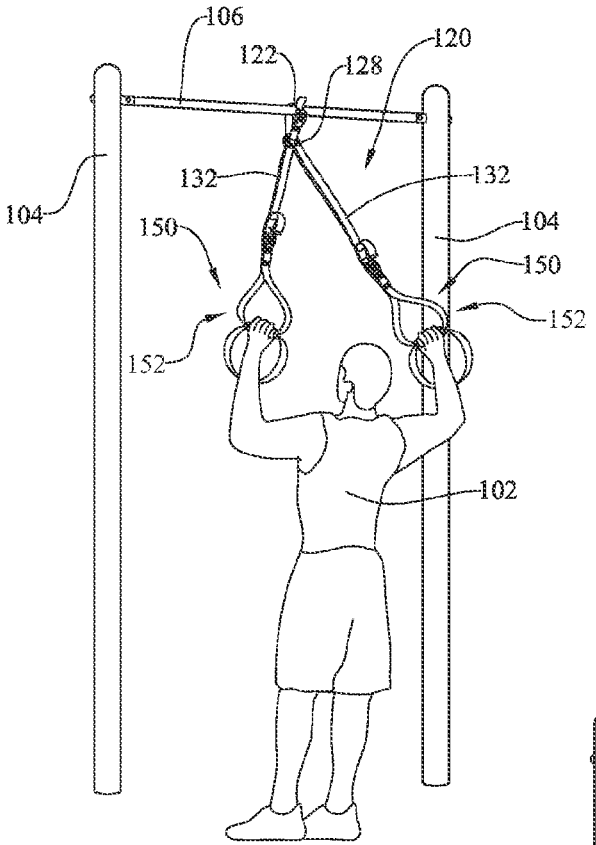
FIG. 6 presents a general perspective view of the exercise device attached to a gym crossbeam and a user performing an exercise utilizing the hand grips.
Figure 7:
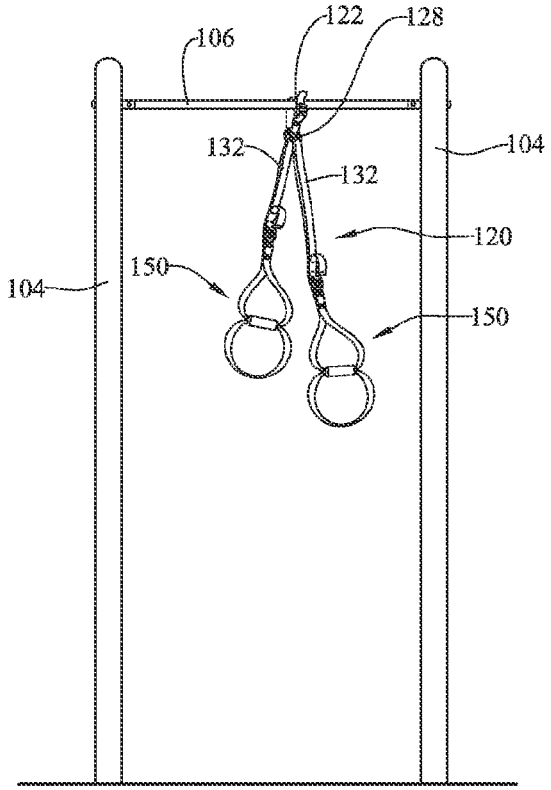
FIG. 7 presents a general perspective view of the exercise device in accordance with the present disclosure, in its initial configuration.
Figure 8:
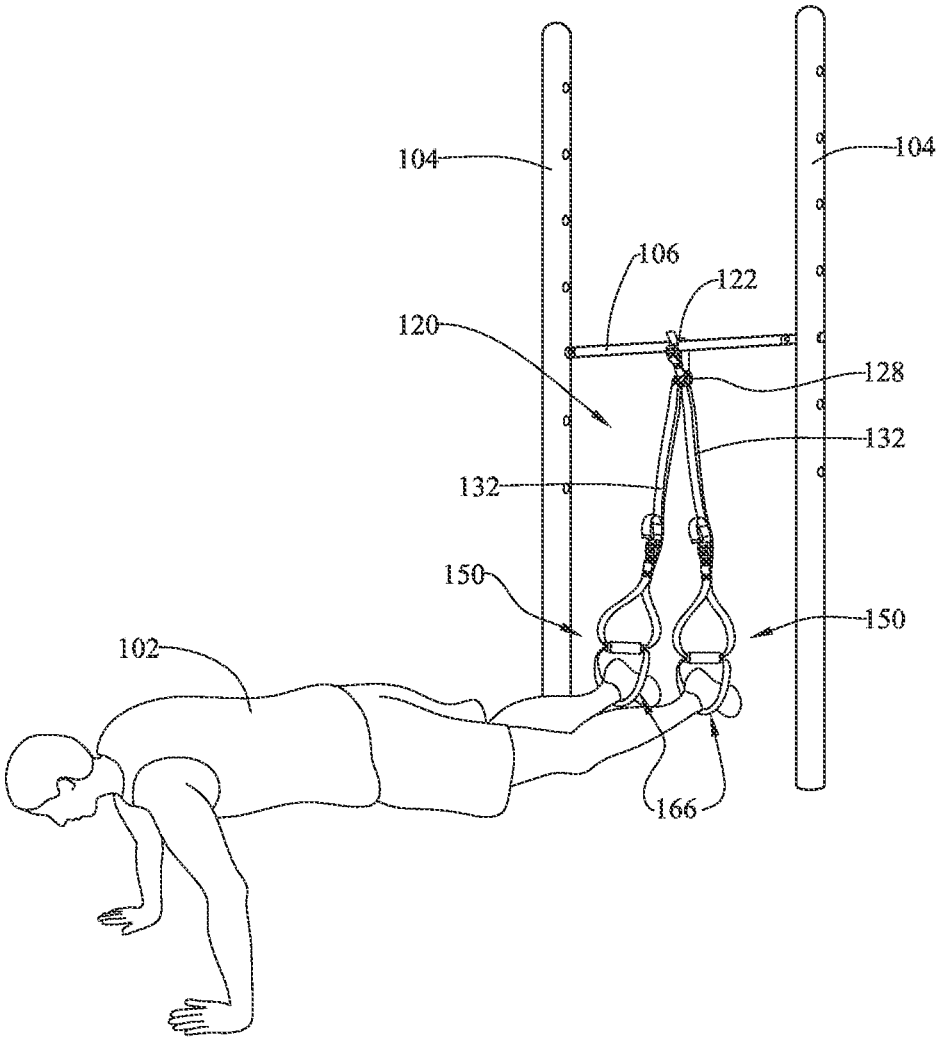
FIG. 8 presents a perspective view of a user using the present exercise device for doing push-ups wherein the user's feet are engaged in the foot grips.

Referring next to FIGS. 6-8, exemplary application of exercise device 120 is illustrated. FIG. 6 illustrates a user 102 gripping grip handles 156 of the respective hand grips 152 and exercising the user's arms with exercise device 120. In this application, anchor 122 of exercise device 120 is secured to a crossbeam 106, which spans a pair of poles 104, as illustrated in FIG. 7. FIG. 8 illustrates an alternative application in which user 102 secure his or her feet using the foot grips 166 while performing push-ups.

As further illustrated in FIG. 6, the inelastic strap assemblies 132 are connected to the anchor 122 via respective rigid rings 128. The lengths of inelastic strap assemblies 132 are fixed by manipulation of the respective buckles 142 wherein the lengths of inelastic strap assemblies 132 remain the same throughout exercise. Therefore, injuries to user 102 which may otherwise occur in the event that the length of one or both inelastic strap assemblies 132 was to change unexpectedly during exercise are prevented.

Figure 9:
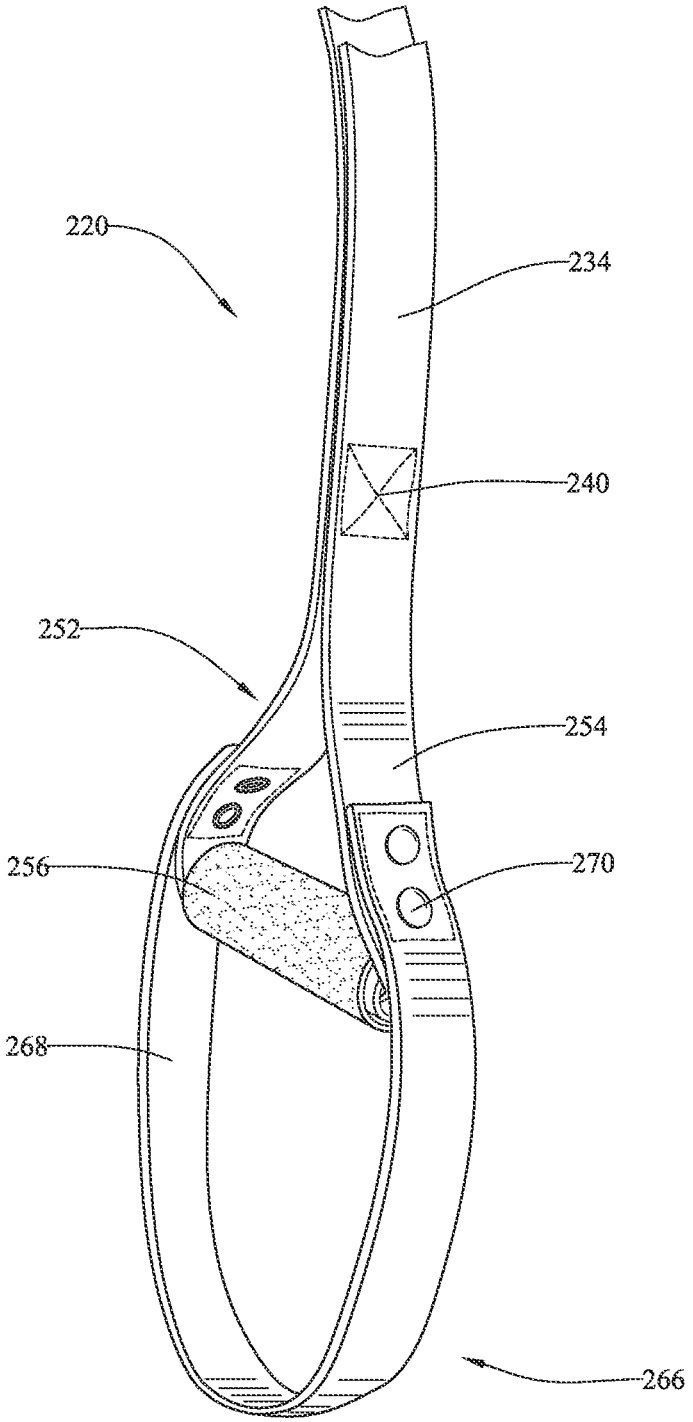
FIG. 9 presents a perspective view of an alternate embodiment attachment of the foot grip to the hand grip.
Figure 10:
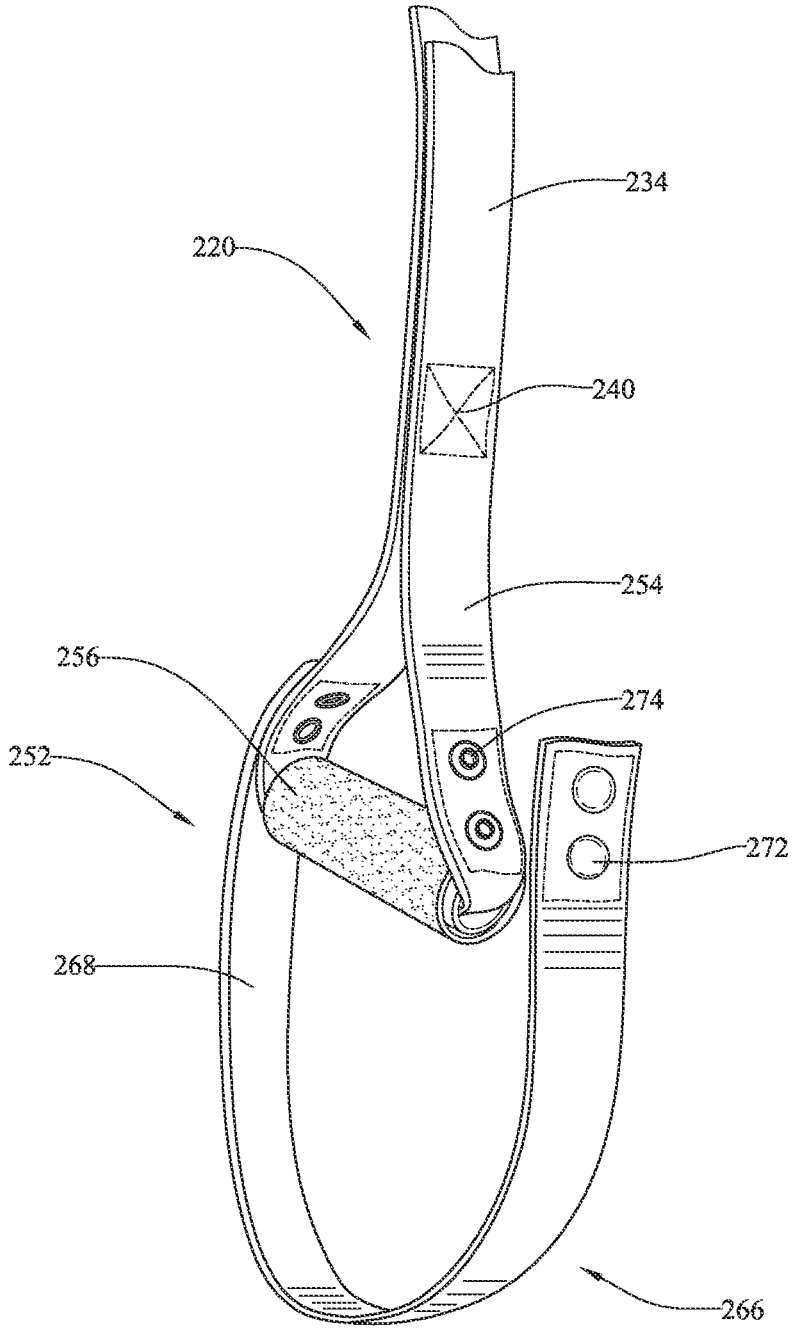
FIG. 10 presents a perspective view of the alternate embodiment foot grip detached from the hand grip.
Figure 11:
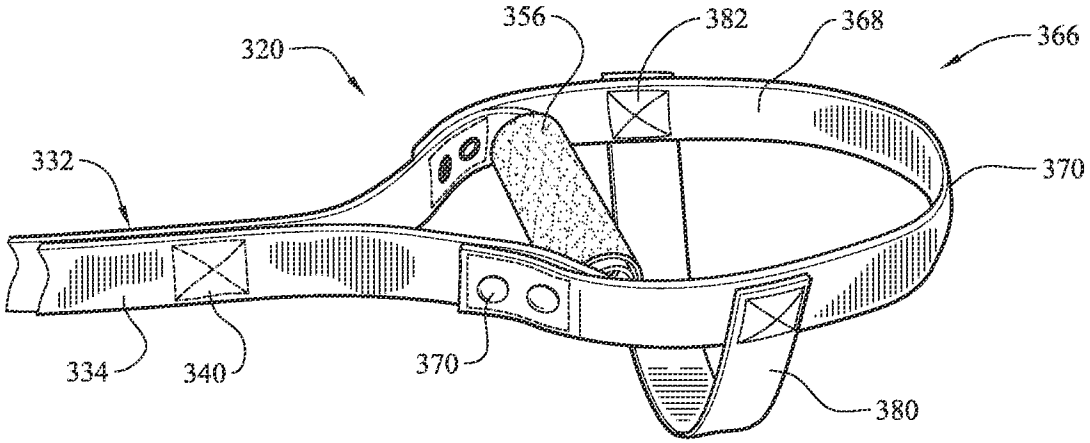
FIG. 11 presents a perspective view of an alternate embodiment foot grip detached from the hand grip with a heel strap attached to the foot grip.

Referring now to FIGS. 9-10, an alternate embodiment exercise device 220 is shown wherein features thereof corresponding to features of exercise device 120 end in like reference numerals preceded by the numeral "2". Exercise device 220 is constructed of a webbed inelastic strap 234 which has at one end thereof a hand grip 252 formed by the doubling back of inelastic strap 234 upon itself and affixed one to the other by stitching portion 240. Hand grip 252 is formed as a continuous hand strap 254. A cylindrical grip handle 256 has an axial passageway therethrough in which is received a portion of hand strap 254. Hand strap 254 includes at least one, and preferably a plurality of snap portions, such as male snap portions 274 (FIG. 10) affixed external to and at each end of cylindrical grip handle 256. A discontinuous foot strap 268 is preferably formed of webbed strap material identical to inelastic strap 234 and includes at each end thereof one and preferably a plurality of mating snap portions such as female snap portions 272 (FIG. 10).

Female snap portion 272 (FIG. 10) when engaged with male snap portion 274 forms snap 270 (FIG. 9) for retaining foot strap 268 on hand strap 254 of hand grip 252 and thereby forming foot grip 266. Snaps 270 form an attachment mechanism to permit the selective removal and attachment of foot strap 268 from exercise device 220. Further, in embodiments in which one or both hand grip 252 and foot strap 268 include a plurality of respective snap portions 272, 274, female snap portions 272 can be engaged with different male snap portions to adjust the size of foot grip 266 to accommodate different foot sizes and comfort of a user of exercise device 220.

Those practiced in the art will understand that any detachable engaging interface can be alternately provided replacing the female snap portion 272 and the male snap portion 274. The detachable engaging interface should be selected from any form factor capable of supporting the desired load when in use, while ensuring ease of separation when desired. Several examples of potential detachable engaging interfaces include a buckle, a dense hook and loop fastener, a button and buttonhole, a hook and eye, and the like.

In another embodiment, one end of the foot strap 268 can be attached to a respective end of the hand strap 254 using stitching and a second end of the foot strap 268 can be adjustably attached to a respective second end of the hand strap 254 using any detachable engaging interface, such as those listed above.

For extreme loading conditions, both ends of the foot strap 268 can be secured to the hand strap 254 using stitching. By affixing the foot strap 268 to the hand strap 254, the foot strap 268 remains stationary.

Referring now to FIGS. 11-17, an alternate embodiment exercise device 320 is shown wherein features thereof corresponding to features of exercise device 120 end in like reference numerals preceded by the numeral "3". The exercise device 320 includes an ankle strap 380 which is attached to opposite sides of the foot strap 368 of the foot grip 366 such as by stitching portions 382, for example and without limitation. The ankle strap 380 may be generally curved and oriented in a plane that is perpendicular to the plane of the foot strap 368. The ankle strap 380 may be disposed generally between the grip handle 356 and the looped terminus or end 370 of the foot strap 368.

Figure 12:
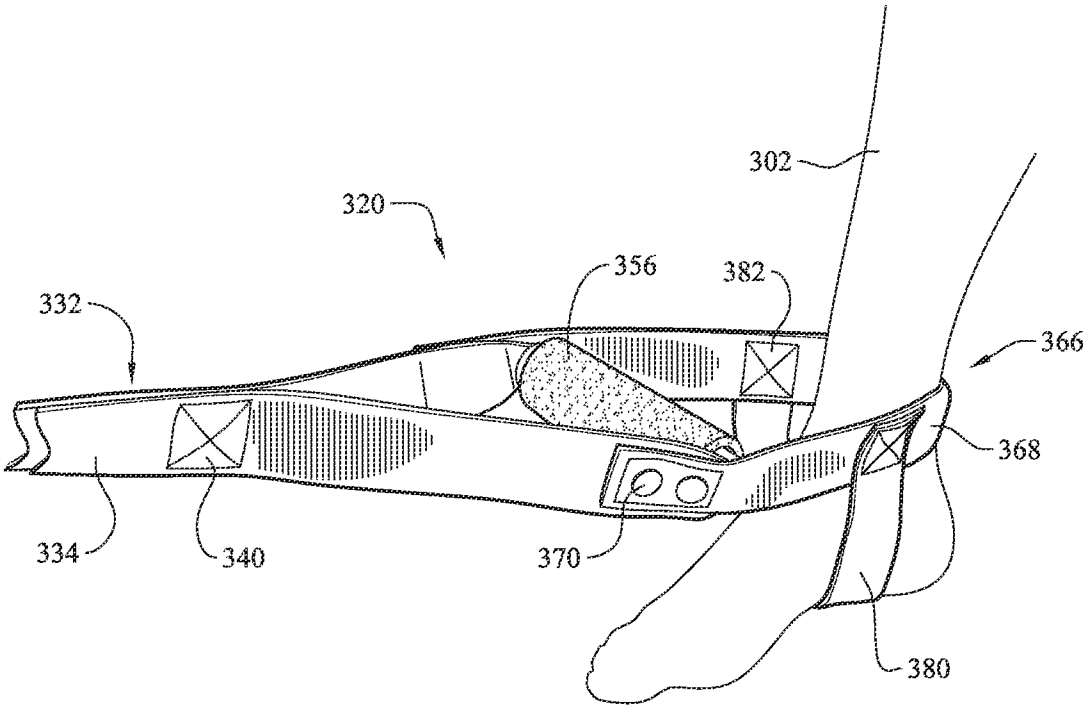
FIG. 12 presents a perspective view of the alternate embodiment foot grip illustrated in FIG. 11 with a user's foot extending through the foot grip and supported by the heel strap.

As illustrated in FIG. 12, in some applications the exercise device 320 can be used to exercise a leg of the user 302. The user 302 inserts his or her foot through the foot strap 368 of the foot grip 366. The bottom of the user's heel rests on the heel strap 380. The user 302 can pull against the resistance that is imparted by the inelastic straps 334 of the inelastic strap assemblies 332 to exercise and strengthen the muscles in the legs of the user 302. The heel strap 380 stabilizes the foot of the user 302 in the foot grip 366 to prevent the foot of the user 302 from inadvertently slipping too far into the foot grip 366.

Figure 13:
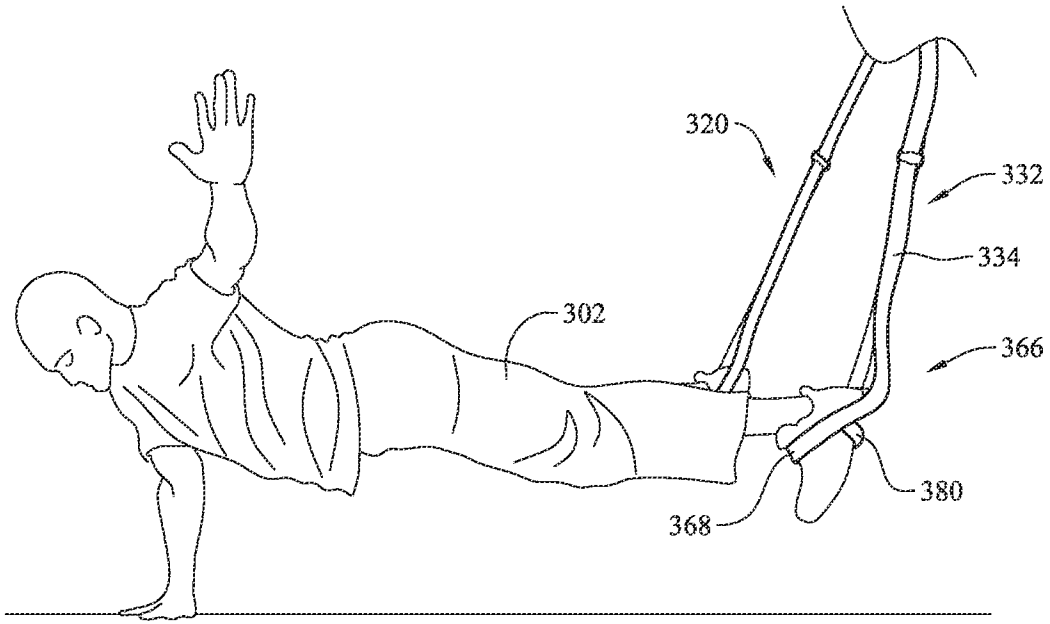
FIG. 13 presents a perspective view of the alternate embodiment foot grip illustrated in FIG. 11 with a user's feet extending through the respective foot grips of the exercise device in performance of an exercise.

As illustrated in FIG. 13, in some applications the exercise device 320 can be used to hold the feet of a user 302 as the user 302 performs push-ups. The user 302 inserts both of his or her feet through the respective foot grips 366. The foot strap 368 of each foot grip 366 engages the instep portion whereas the heel strap 380 engages the heel portion of the user's foot. Therefore, the exercise device 320 suspends the feet of the user 302 as the user performs push-ups with one or both arms.

Figure 14:
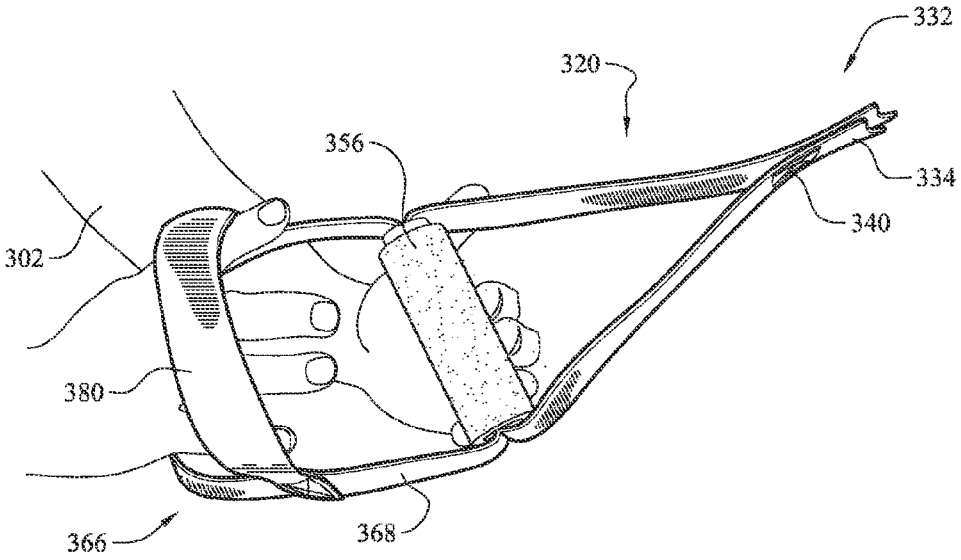
FIG. 14 presents a perspective view of the alternate embodiment foot grip illustrated in FIG. 11 illustrating initial insertion of a user's hand between the heel strap and the foot strap of the foot grip in gripping of the grip handle preparatory to performing arm exercises using the exercise device.
Figure 15:
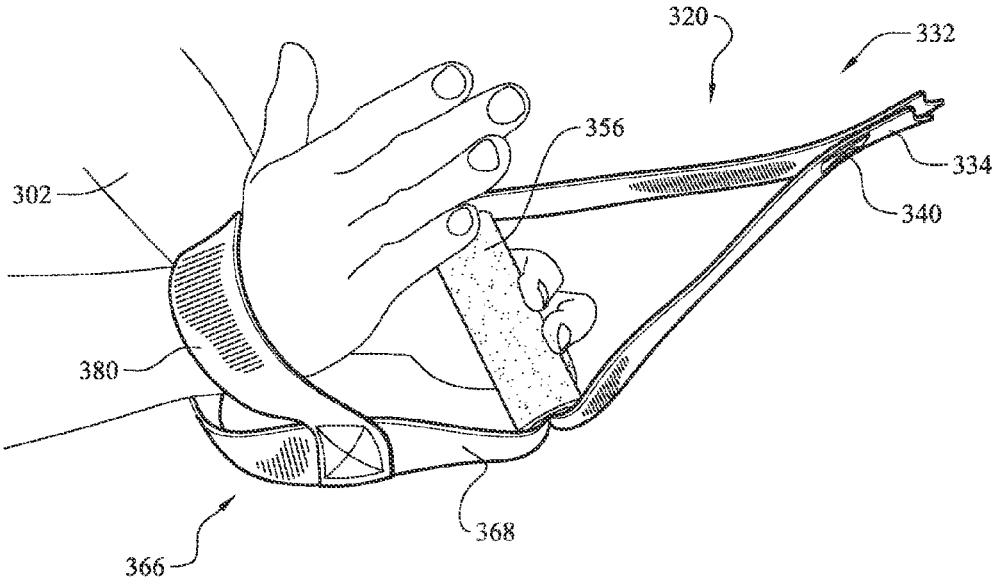
FIG. 15 presents a perspective view of the alternate embodiment foot grip illustrated in FIG. 11 illustrating complete insertion of the user's hand between the heel strap and the foot strap of the foot grip in gripping of the grip handle.
Figure 16:
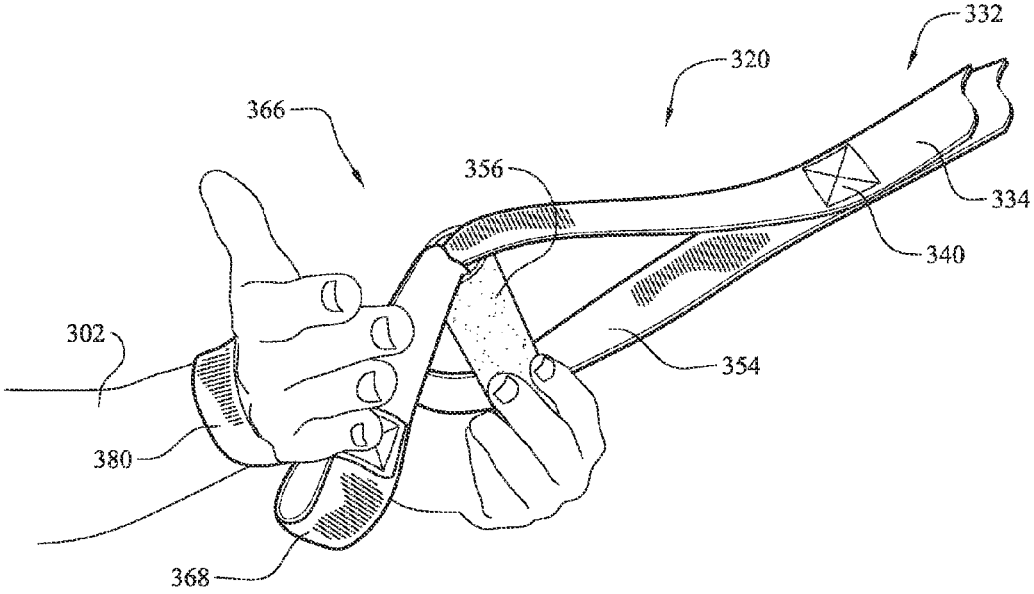
FIG. 16 presents a perspective view of the alternate embodiment foot grip illustrated in FIG. 11 illustrating wrapping of the foot strap around the wrist of the user.
Figure 17:
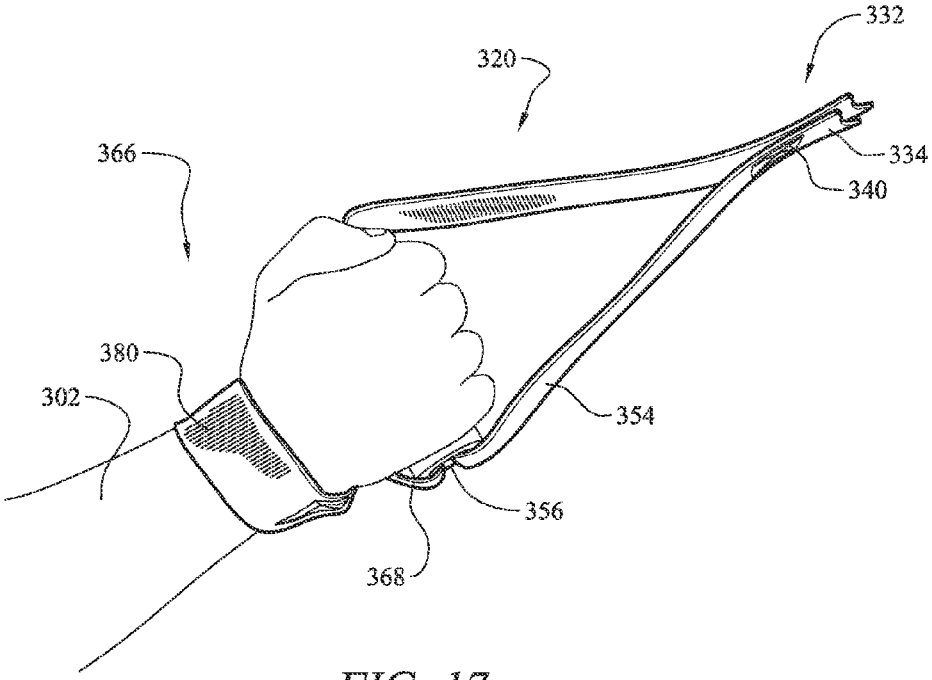
FIG. 17 presents a perspective view of the alternate embodiment foot grip illustrated in FIG. 11 illustrating gripping of the grip handle with the user's hand in performance of arm exercises using the exercise device.

As illustrated in FIGS. 14-17, in some applications the exercise device 320 can be used to exercise one or both arms of a user 302. As illustrated in FIG. 14, the user 302 initially extends his or her fingers between the foot strap 368 and the heel strap 380 of the foot grip 366. As illustrated in FIG. 15, the user 302 continues to extend his or her hand between the foot strap 368 and the heel strap 380 until the heel strap 380 engages the rear portion of the user's wrist. As illustrated in FIG. 16, the user 302 wraps the foot strap 368 around his or her wrist and then grips the grip handle 356, as illustrated in FIG. 17. The user 302 can then pull against the resistance, which is imparted by the inelastic strap assembly 332 to exercise the arm or arms of the user 302.

Since many modifications, variations, and changes in detail can be made to the described preferred embodiments of the invention, it is intended that all matters in the foregoing description and shown in the accompanying drawings be interpreted as illustrative and not in a limiting sense. This, the scope of the invention should be determined by the appended claims and their legal equivalence.

We claim:

1. An exercise device, comprising:

at least one inelastic strap assembly including an inelastic strap having a first end and a second end;

a looped hand grip at said first end of said inelastic strap, said looped hand grip delimiting an internal hand grip space;

a grip handle carried by said hand grip, wherein said looped hand grip passes through said grip handle;

a looped foot grip carried by said looped hand grip, wherein said looped foot grip extends between opposite ends of said grip handle and not into said grip handle, delimiting an internal foot grip space, and wherein opposite ends of said looped foot grip are affixed to opposite sides of said looped hand grip; and a heel strap carried by said looped foot grip.

2. The exercise device according to claim 1, wherein said heel strap is disposed in a first plane and said looped foot grip is disposed in a second plane, said first plane and said second plane having a non-parallel arrangement.

3. The exercise device according to claim 2, wherein said first plane is generally perpendicular to said second plane.

4. The exercise device according to claim 1 wherein at least one of said opposite ends of said looped foot grip is detachably affixed to said looped hand grip.

5. The exercise device according to claim 4 wherein both of said opposite ends of said looped foot grip are detachably affixed to said looped hand grip.

6. The exercise device according to claim 4 wherein said looped foot grip comprises a foot strap having two ends, wherein said foot strap is adjustable with respect to said hand grip, wherein at least one of said hand grip and said ends of said foot strap includes a plurality of spaced apart snap portions to provide adjustability of said foot strap on said hand grip.

7. The exercise device according to claim 1 wherein at least one of said opposite ends of said looped foot grip is stationarily affixed to said looped hand grip.

8. The exercise device according to claim 7 wherein both of said opposite ends of said looped foot grip are stationarily affixed to said looped hand grip.

9. An exercise device, comprising:

at least one inelastic strap assembly including an inelastic strap having a first end and a second end;

a hand grip having a looped hand strap at said first end of said inelastic strap, said looped hand strap delimiting an internal hand grip space, said looped hand strap comprising an inner surface facing said internal hand grip space and an outer surface opposed to said internal hand grip space;

a grip handle carried by said hand strap of said hand grip, wherein said looped hand strap passes through said grip handle;

a foot grip formed by a looped foot strap carried by said looped hand strap of said hand grip, wherein said looped foot strap extends between opposite ends of said grip handle and not into said grip handle, delimiting an internal foot grip space;

an attachment mechanism attaching opposite ends of said looped foot strap of said foot grip to said outer surface of said looped hand strap of said hand grip at opposite sides of said looped hand strap; and a heel strap carried by said looped foot strap of said foot grip.

10. The exercise device according to claim 9, wherein said heel strap is disposed in a first plane and said foot strap is disposed in a second plane, said first plane and said second plane having a non-parallel arrangement.

11. The exercise device according to claim 10, wherein said first plane is generally perpendicular to said second plane.

12. The exercise device according to claim 9 wherein at least one of said opposite ends of said looped foot strap is detachably affixed to said looped hand strap.

13. The exercise device according to claim 12 wherein both of said opposite ends of said looped foot strap are detachably affixed to said looped hand strap.

14. The exercise device according to claim 9 wherein at least one of said opposite ends of said looped foot strap is stationarily affixed to said looped hand strap.

15. The exercise device according to claim 14 wherein both of said opposite ends of said looped foot strap are stationarily affixed to said looped hand strap.

16. An exercise device, comprising:

at least one inelastic strap assembly including an inelastic strap having a first end and a second end;

a hand grip having a looped hand strap at said first end of said inelastic strap, said looped hand strap delimiting an internal hand grip space, said looped hand strap comprising an inner surface facing said internal hand grip space and an outer surface opposed to said internal hand grip space;

a grip handle carried by said hand strap of said hand grip, wherein said looped hand strap passes through said grip handle;

a foot grip formed by a looped foot strap carried by said looped hand strap of said hand grip, wherein said looped foot strap extends between opposite ends of said grip handle and not into said grip handle, delimiting an internal foot grip space, and wherein opposite ends of said looped foot strap are stationarily affixed to said outer surface of said looped hand strap of said hand grip at opposite sides of said looped hand strap; and a heel strap carried by said looped foot strap of said foot grip.

17. The exercise device according to claim 16, wherein said heel strap is disposed in a first plane and said looped foot strap is disposed in a second plane, said first plane and said second plane having a non-parallel arrangement.

18. The exercise device according to claim 17, wherein said first plane is generally perpendicular to said second plane.

* * * * *